US006651545B2

(12) United States Patent
Nippert

(10) Patent No.: US 6,651,545 B2
(45) Date of Patent: Nov. 25, 2003

(54) FLUID TRANSLATING DEVICE

(75) Inventor: Andrew H. Nippert, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/021,869

(22) Filed: Dec. 13, 2001

(65) Prior Publication Data

US 2003/0110935 A1 Jun. 19, 2003

(51) Int. Cl.[7] ..... F01B 1/00; F01B 13/04; F01B 3/00

(52) U.S. Cl. ..... 91/476; 91/491; 417/270

(58) Field of Search ..... 91/491, 496, 497, 91/498, 476, 481; 417/269, 270, 296, 297, 298, 505, 53; 137/487.5, 625.66, 625.69

(56) References Cited

U.S. PATENT DOCUMENTS

| | | | | |
|---|---|---|---|---|
| 2,785,638 A | | 3/1957 | Moller | |
| 3,459,363 A | | 8/1969 | Miller | |
| 3,738,111 A | * | 6/1973 | Fletcher | 417/202 |
| 4,004,498 A | * | 1/1977 | Aoki | 91/476 |
| 4,241,714 A | | 12/1980 | Knape et al. | |
| 4,519,752 A | * | 5/1985 | Valentin | 417/298 |
| 4,541,394 A | | 9/1985 | Schechter et al. | |
| 4,945,816 A | * | 8/1990 | Mestieri | 91/473 |
| 5,190,446 A | | 3/1993 | Salter et al. | |
| 5,255,641 A | * | 10/1993 | Schechter | 123/90.11 |
| 5,259,738 A | * | 11/1993 | Salter et al. | 417/505 |
| 5,356,269 A | | 10/1994 | Stangroom | |
| 5,409,354 A | | 4/1995 | Stangroom | |
| 5,700,136 A | * | 12/1997 | Sturman | 417/270 |
| 5,836,231 A | * | 11/1998 | Leinonen | 91/491 |

FOREIGN PATENT DOCUMENTS

IT 0 651 159 A1 * 5/1995

OTHER PUBLICATIONS

John Deere Marketing Services, Inc.—DKD1046 (88–04 Litho in USA We can help you pump up performance on the road, off t.

Dept. of Mechanical Engineering, Univeristy of Edinburgh, Scotland, SHSalter, WHSRampen, The Wedding–Cake Multi–eccentr.

ASME vol. 122, Mar. 2000 Modeling of Digital–Displacement Pump–Motors and Their Application as Hydraulic Drives for Nonuniform Loads.

Dept. of Mechanical Engineering—Univ. of Edinburgh, UK, Simulation and Dyanmic Response of Computer Controlled Digital.

FPST—vol. 3 Fluid Power Systems and Technology: Collected Papers ASME 1996.

Written Discussion The control of cruciform testing systems using opposed pairs of servo–hydraulic actuators J. McAllist.

Constant Pressure control of the Digital Displacement Hydraulic Piston Pump—W. Rampen, S. Salter & A. Fussey.

* cited by examiner

*Primary Examiner*—Charles G. Freay
*Assistant Examiner*—Han L Liu
(74) *Attorney, Agent, or Firm*—J. W. Burrows; Steven G Kibby

(57) ABSTRACT

It is desirable to deliver only the fluid that is used to do useful work and not waste energy. In the subject arrangement, selected ones of a plurality of pistons are held at their top dead center positions when delivery therefrom is not needed. This is accomplished by having a valving arrangement disposed between the associated pressure chambers and first and second inlet/outlet ports. The valving arrangement is movable from a neutral, flow blocking position to an operative flow passing position. At the flow blocking position, fluid flow into and out of the associated pressure chamber is blocked, thus the associated piston is maintained at the top dead center position. By holding selected ones of the pistons at the top dead center position, the effective volume of fluid being used is reduced and energy is saved due to the fact that the selected pistons are not moving any fluid.

12 Claims, 5 Drawing Sheets

FLUID TRANSLATING DEVICE

TECHNICAL FIELD

The subject invention generally relates to controlling energy losses in fluid translating devices and more particularly to controlling the motion of the respective pistons when they are not in use.

BACKGROUND

Fluid translating devices are well known in the art and may be in the form of a fluid pump or a fluid motor. Piston types of fluid translating devices are normally used in systems to provide high operating torques and/or pressures. They may be in the form of radial piston designs, axial piston designs, bent axis designs or other known designs. In either of the types, a plurality of pistons are used and they reciprocate in and out of respective piston bores. When it is desired to change the flow displacement within the fluid translating device, energy is wasted by having to move the respective pistons in and out of the piston bores. It has been known to inactivate all of the pistons during use in order to hold the pistons in a predetermined position so that energy may be saved when the fluid is not needed to do useful work. One example of such a system is illustrated in the brochure entitled "We can help you pump up performance on the road, off the road, and down the road" published by Deere Inc. in April 1988. In the brochure, it teaches subjecting the internal cavity with pressurized fluid that forces each of the pistons to retract into their respective piston bores when the fluid flow into their respective pressure chambers is shut off. The pressurized fluid in the internal cavity is effective to move the respective pistons into their piston bores but the pressurized fluid within the internal cavity induces extra leakage paths and also creates unwanted drag forces therein.

The present invention is directed to overcoming one or more of the problems set forth above.

SUMMARY OF THE INVENTION

In one aspect of the present invention, a variable displacement fluid translating device is provided and comprises a housing, a rotating cam, a plurality of piston bores, a plurality of pistons, a plurality of pressure chambers and a valving arrangement. The housing has first and second inlet/outlet ports and defines a reference axis therethrough. The rotating cam is disposed in the housing along the reference axis and has a cam surface. The plurality of piston bores are defined in the housing about the reference axis and each bore of the plurality of piston bores has a bottom portion. The plurality of pistons are slideably disposed in the plurality of piston bores and are selectively in mating contact with the cam surface of the rotating cam. The plurality of pressure chambers are defined in the housing between the respective one of the plurality of pistons and the bottom portion of the respective ones of the plurality of piston bores. The valving arrangement is connected between selected pressure chambers of the plurality of pressure chambers and the respective first and second inlet/outlet ports. The valving arrangement is operative to selectively block fluid flow in and out of each pressure chamber to hold the respective piston at a predetermined position.

In another aspect of the present invention, a method is provided to control the relative position of respective ones of a plurality of pistons within a variable displacement fluid translating device. The method comprises the following steps: provide a housing having first and second inlet/outlet ports and a reference axis; provide a rotating cam having a cam surface in the housing along the reference axis; form a plurality of piston bores in the housing about the reference axis; provide a plurality of pistons in the plurality of piston bores that are slideably disposed in the respective piston bores and that are selectively in mating contact with the cam surface of the rotating cam; establish a plurality of pressure chambers between the respective one of the plurality of pistons and the respective ones of the plurality of piston bores; and provide a valving arrangement between selected pressure chamber of the plurality of pressure chambers and the respective first and second inlet/outlet ports. In the method each valving arrangement is operative to selectively block the fluid flow in and out of each pressure chamber to maintain the associated piston at a predetermined position.

DETAILED DESCRIPTION

Figure 1:
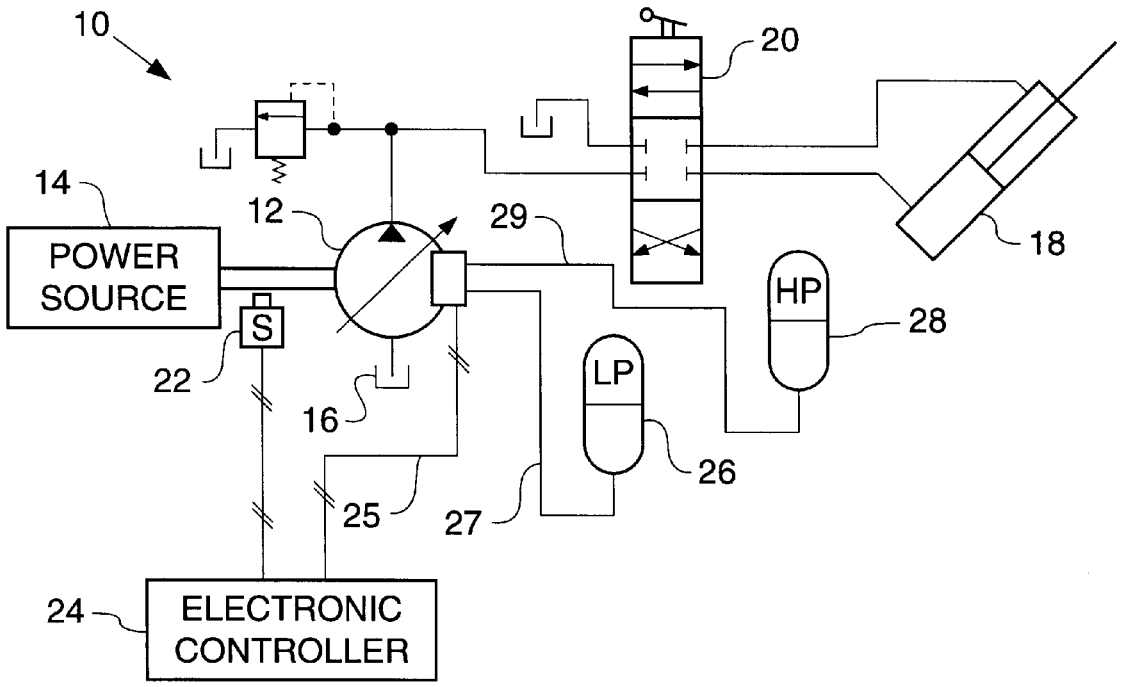
FIG. 1 is a schematic representation of a work system utilizing the subject invention.

Referring to FIG. 1 of the drawings, a work system 10 is illustrated and includes a variable displacement fluid translating device 12, such as a fluid pump, that is driven by a power source 14. The variable displacement fluid translating device 12 draws fluid from a reservoir 16 and delivers pressurized fluid to a work element 18, such as a fluid cylinder, through a directional control valve 20. The variable displacement fluid translating device 12 could be a fluid pump or a fluid motor and will be described in more detail herein after. Likewise the variable displacement fluid translating device could be radial, wobble plate, axial or bent axis design. The work system 10 of the subject embodiment could be, for example, an implement system.

A speed and position sensor 22 is associated with the variable displacement fluid translating device 12 and is operative to detect the speed of the variable displacement fluid translating device 12 and the rotational position of its internal mechanism. It is recognized that the speed and position sensor 22 could be disposed within the variable displacement fluid translating device 12. The detected speed and position is delivered to a controller 24. The controller 24 is also operatively connected by a wiring harness 25 to the variable displacement fluid translating device 12.

A source of low pressure fluid 26, such as a low pressure accumulator, and a high pressure accumulator 28 are also operatively connected by respective conduits 27,29 to the variable displacement fluid translating device 12.

Figure 2:
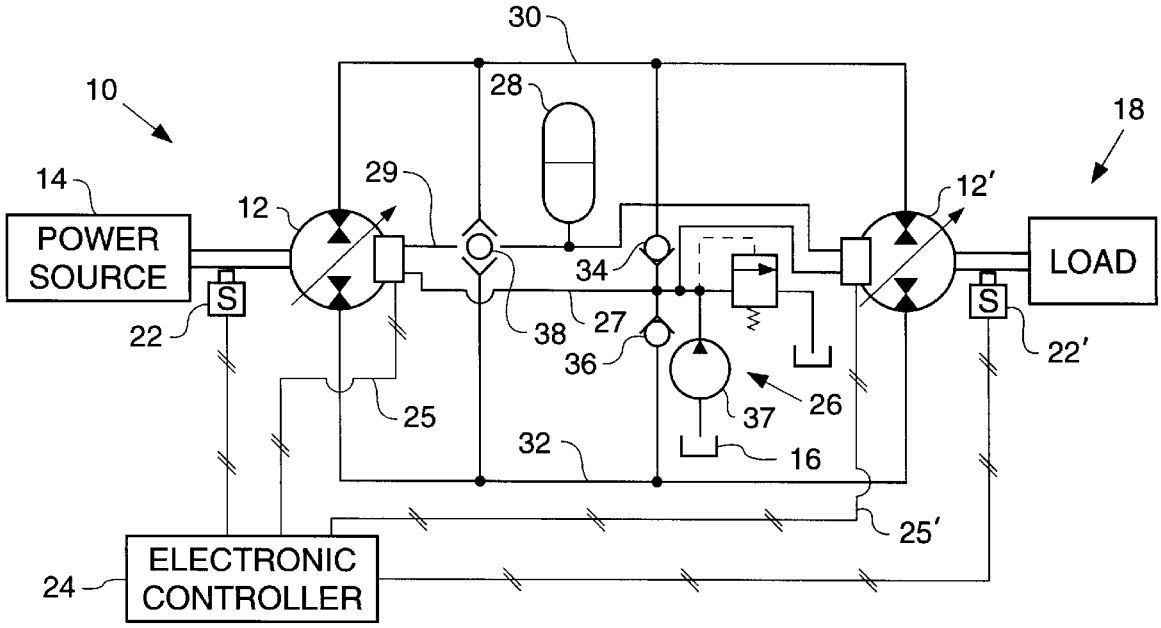
FIG. 2 is a schematic representation of another work system utilizing the subject invention.

Referring to FIG. 2, another embodiment of a work system 10 is illustrated. Like elements have like element numbers. The work system 10 of FIG. 2 includes the power source 14 drivingly connected to the variable displacement fluid translating device 12. The work element 18 of the subject embodiment is a second variable displacement fluid translating device 12', such as a fluid motor, and is fluidity connected to the first variable displacement fluid translating device by conduits 30,32.

The speed and position sensor 22 functions in the same manner as that of FIG. 1. A second speed and position sensor 22' is associated with the second variable displacement fluid translating device 12' and is also connected to the controller 24. The second speed and position sensor 22' functions in the same manner as the first speed and position sensor 22. A second wiring harness 25' connects the controller 24 to the second variable displacement fluid translating device 12'.

The source of low pressure 26 is operatively connected to both of the first and second variable displacement fluid translating devices 12,12' and is also connected through first and second one way check valves 34,36 to the respective conduits 30,32. In the subject embodiment, the source of low pressure fluid 26 is a pilot pump 37.

The high pressure accumulator 28 is connected to the both the first and second variable displacement fluid translating devices 12,12' and is also connected to the first and second conduits 30,32 through the resolver valve 38.

The variable displacement fluid translating device 12 of FIG. 1 could be the same as that of FIG. 2, but the variable displacement fluid translating device 12 of FIG. 1 needs to only function in two quadrants. That is, the variable displacement fluid translating device 12 of FIG. 1 need only be capable of pump fluid only in one direction and motoring in the opposite direction. This means that the high pressure port of the variable displacement fluid translating device 12 of FIG. 1 will always be the high pressure port and the low pressure port will always be the low pressure port. The variable displacement fluid translating device of FIG. 2, however must be able to function in all four quadrants. That is, it must be capable of pumping and motoring fluid in both directions. This means that the high and low pressure ports must be able to be reversed during operation depending on the operating parameters of the work system 10. Reversing of the low and high pressure ports effectively is a change in flow direction within the variable displacement fluid translating device 12.

Figure 3:
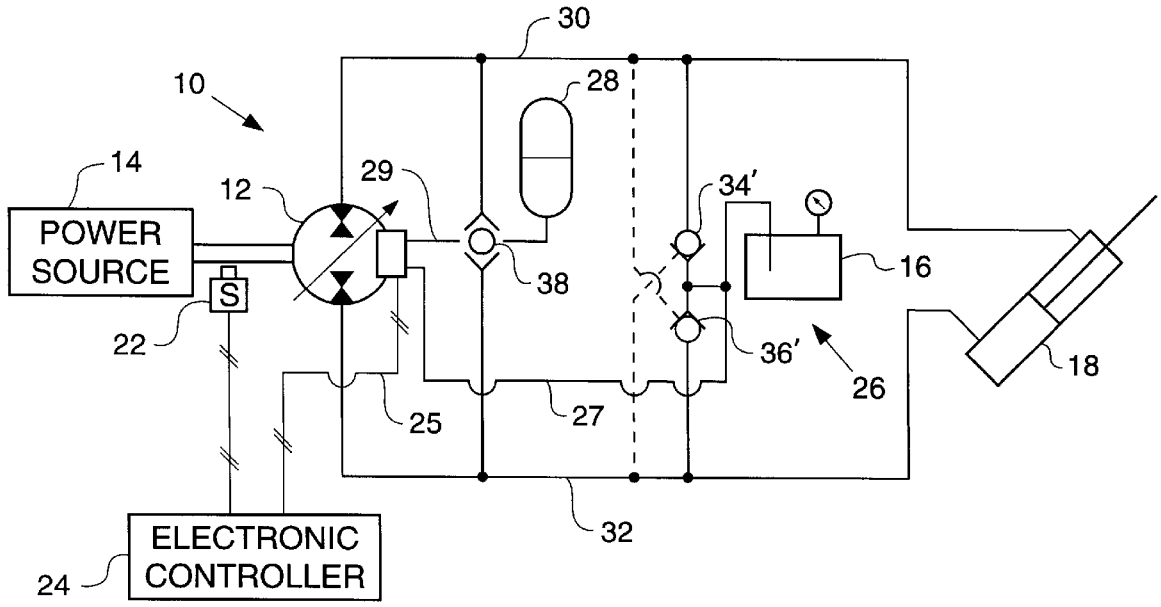
FIG. 3 is a schematic representation of yet another work system utilizing the subject invention.

Referring to the work system 10 in the embodiment of FIG. 3, the power source 14 is drivingly connected to the variable displacement fluid translating device 12 which in turn is fluidity connected to the work element 18 the conduits 30,32. The variable displacement fluid translating device 12 of FIG. 3 is capable of functioning in all four quadrants. The work element 18 of the subject embodiment is a typical fluid cylinder or it could be a well known fluid motor.

The speed and position sensor 22 is connected and functions the same as the speed and position sensor 22 of FIGS. 1 and 2. Likewise, the controller 24 is connected to the variable displacement fluid translating device 12 by the wiring harness 25.

In the subject embodiment of FIG. 3, the reservoir 16 is a pressurized reservoir and serves as the source of low pressure fluid 26. The first and second one way check valves 34,36 of the subject embodiment are pilot operated one way check valves 34',36' and the source of low pressure fluid 26 is connected through the first and second pilot operated one way check valves 34',36' with the conduits 30,32. The first pilot operated one way check valves 34' is responsive to pressurized fluid in the conduit 32 while the second pilot operated one way check valve 36' is responsive to pressurized fluid in the conduit 34.

The high pressure accumulator 28 is connected with the variable displacement fluid translating device 12 and connected with the first and second conduits 30,32 through the resolver valve 38 in the same manner as that of FIG. 2.

Figure 4:
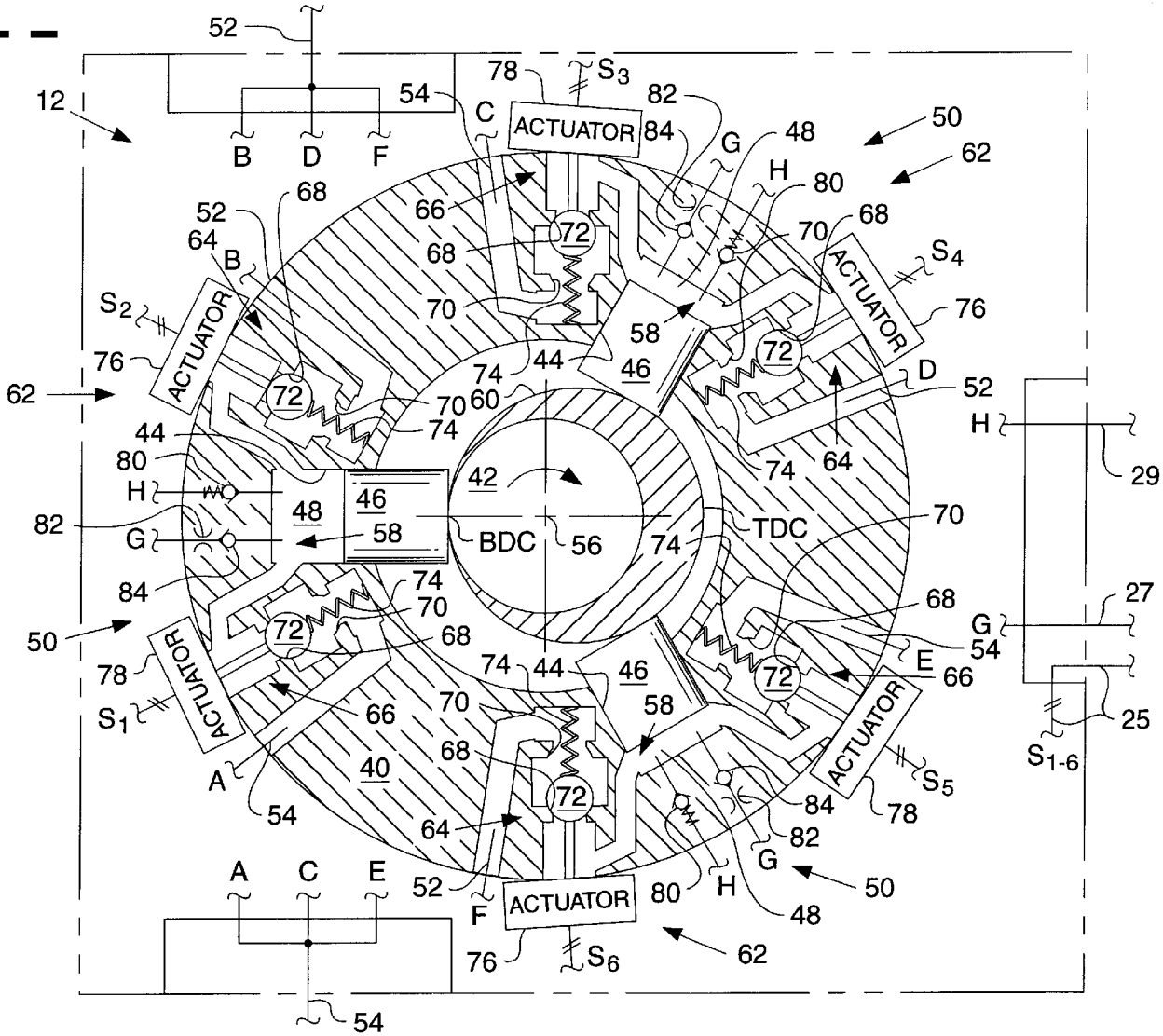
FIG. 4 is a diagrammatic representation of an embodiment of the subject invention.
Figure 5:
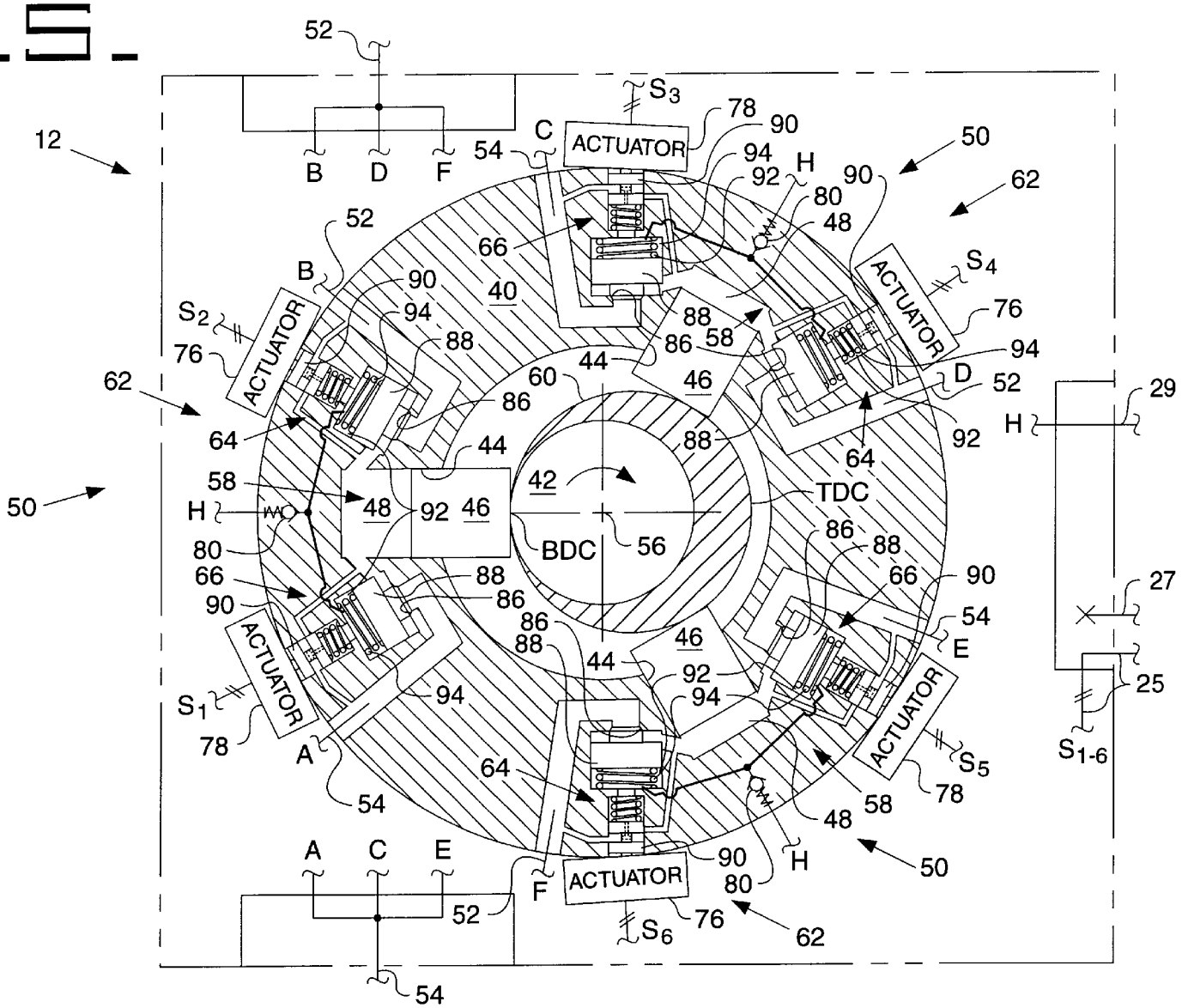
FIG. 5 is a diagrammatic representation of another embodiment of the subject invention.
Figure 6:
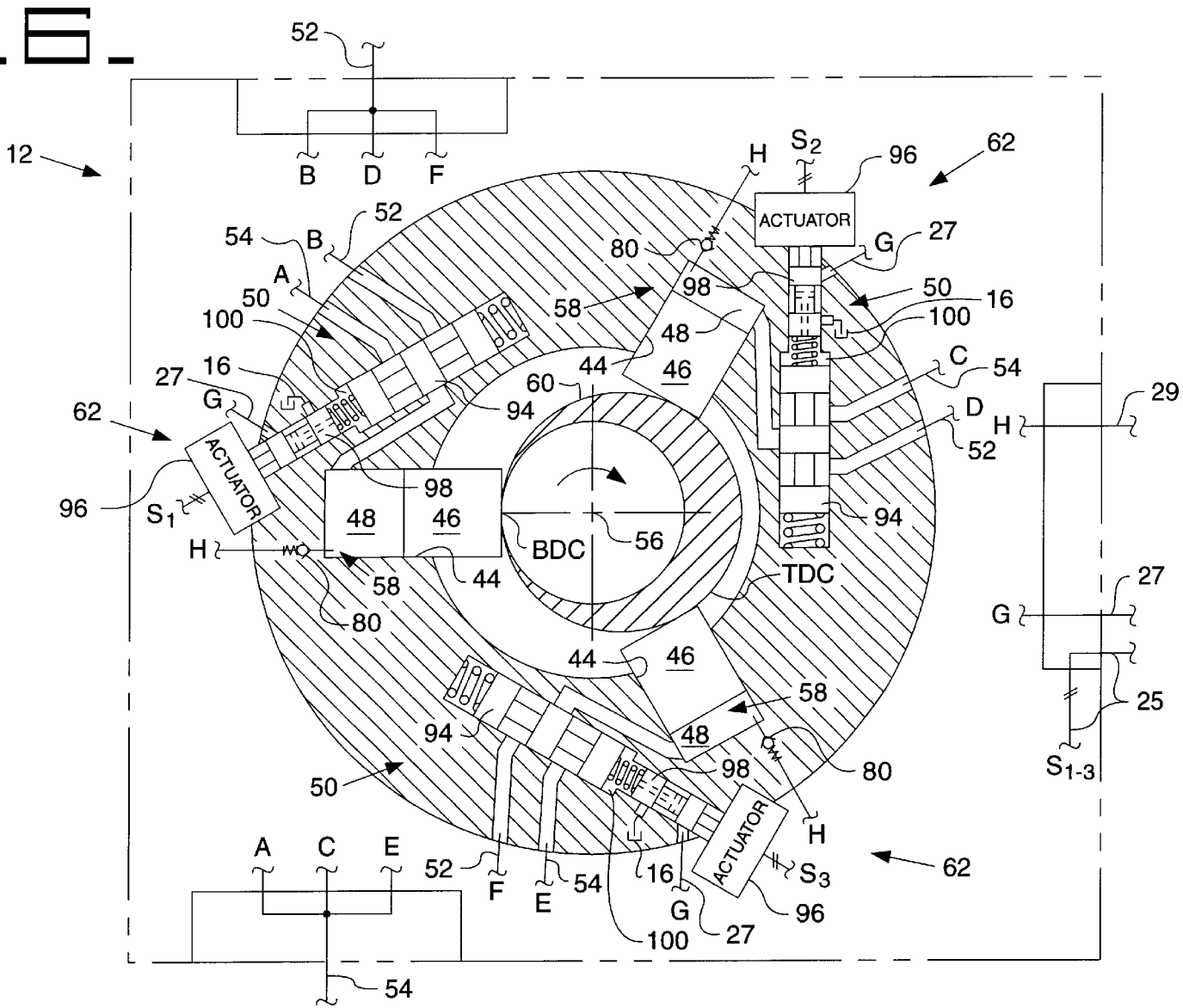
FIG. 6 is a diagrammatic representation of yet another embodiment of the subject invention.

Referring to FIGS. 4–6, different embodiments of the variable displacement fluid translating device 12 are illustrated. The variable displacement fluid translating device 12 of each embodiment includes a housing 40, a rotating cam 42, a plurality of piston bores 44, a plurality of pistons 46, a plurality of pressure chambers 48 and a valving arrangement 50. It is recognized that any number of pistons 46 and piston bores 44 could be utilized in the subject embodiments. The housing 40 has first and second inlet/outlet ports 52,54 and a reference axis 56 extending therethrough.

The plurality of piston bores 44 defined in the housing 40 each has a bottom portion 58 and is defined therein extending radially outward from and about the reference axis 56. Each of the respective piston bores 44 is evenly spaced from one another about the reference axis 56. The plurality of pistons 46 are slideably disposed within the plurality of piston bores 44 to define the plurality of pressure chambers 48 between the bottom portion 58 of each piston bore of the plurality of piston bores 44 and one end of the associated piston of the plurality of pistons 46.

The rotating cam 42 has a cam surface 60 disposed thereon eccentric from the reference axis 56. The amount of eccentricity of the cam surface 60 relative to the reference axis 56 determines the maximum displacement or movement of the respective pistons of the plurality of pistons 46 within their respective plurality of piston bores 44. The other end of the respective pistons 46 is in selective engagement with the cam surface 60 of the rotating cam 42. Once the cam surface 60 on the rotating cam 42 moves the associated one of the pistons 46 into its associated piston bore 44 as far as possible, the one piston 46 is at a top dead center position 'TDC'. When the piston 46 is furthest from the bottom portion 58 of the associated piston bore 44, the piston is at its bottom dead center position 'BDC'.

Each of the valving arrangements 50 is disposed between the respective pressure chambers 48 and the first and second inlet/out ports 52,54. Each of the valving arrangements 50 is movable from a neutral, flow blocking position to an operative, flow passing position in response to respective electrically controlled actuator arrangements 62. The respective electrically controlled actuator arrangements 62 are connected to the controller 24 through the wiring harness 25. Each of the valving arrangements 50 is operative to control the direction of fluid flow between the respective pressure chambers 48 and the first and second inlet/outlet ports 52,54. When the valving arrangement 50 is at its neutral, flow blocking position, the associated piston 46 is held at a predetermined position. The predetermined position in the subject arrangements is at top dead center 'TDC'.

Each of the valving arrangements 50 of FIG. 4 includes first and second valving assemblies 64,66. The first valving assembly 64 is disposed between the respective pressure chambers 48 and the first inlet/outlet port 52 and the second valving assembly 66 is disposed between the respective pressure chambers 48 and the second inlet/outlet port 54. Each of the first and second valving assemblies 64,66 is movable from a neutral, flow blocking position towards an operative, flow passing position.

Each of the first and second valving assemblies 64,66 has first and second valve seats 68,70 disposed therein with a ball check 72 disposed therebetween and operative to be selectively seated between or in one of the first and second valve seats 68,70. A biasing member 74 biasing the respective ball checks 72 into engagement with the first valving seat 68.

Each of the electrically controlled actuator arrangements 62 of the subject embodiment includes first and second electrically controlled actuators 76,78. Each of the electrically controlled actuators 76,78 are connected through the wiring harness 25 to the controller 24 and operative to move the respective ball checks 72 between the first and second valve seats 68,70.

The respective pressure chambers 48 are each connected to the high pressure accumulator 28 through respective relief valves 80 and the conduit 29. It is recognized that the relief valves 80 serve only to vent minimal amounts of fluid at a very low differential pressure since the line 29 is connected to the high pressure accumulator 28. The respective pressure chambers 48 are also connected to the source of low pressure fluid through respective orifices 82 and one way check valves 84.

Referring to the embodiment of FIG. 5, like elements have like element numbers. Each of the first and second valving assemblies 64,66 of the valving arrangement 50 in FIG. 5 includes a single valve seat 86 and a pilot operated poppet valve 88. Each of the pilot operated poppet valves 88 is urged into seating engagement with the single valve seat 86 in response to actuation of respective pilot valves 90. The respective pilot valves 90 are disposed between the associated pilot operated poppet valves 88 and the associated electrically controlled actuators 76,78 and each is operative in response to the associated electrically controlled actuators 76,78 to hold the pilot operated poppet valve 88 in the neutral, flow blocking position or to permit it to open to the operative, flow passing position. The respective pilot valves 90 of each of the first and second valving assemblies 64,66 are connected between the associated pressure chamber 48 and the associated one of the first and second inlet/outlet ports 52,54. Movement of the respective pilot valves 90 function to control the pressure of fluid in a pilot control chamber 92 behind the respective pilot operated poppet valves 88. A light weight spring 94 is disposed in the pilot control chamber 92 and functions to urge the pilot operated poppet valve 88 to the neutral, flow blocking position. It is recognized that the pilot valves 90 could be removed and the respective first and second electrically controlled actuators 76,78 could be connected directly to the associated pilot operated poppet valves 88.

Referring to the embodiment of FIG. 6, like elements have like element numbers. The valving arrangement 50 of FIG. 6 has a single valving element 94 and a single electrically controlled actuator 96 associated therewith through a single pilot valve 98. It is recognized that the single electrically controlled actuator 96 could be connected directly to the single valving element. The single valving element 94 is disposed between the respective pressure chambers 48 and the first and second inlet/outlet ports 52,54 and is movable between a neutral, flow blocking position and first and second operative positions. At the neutral position, all flow to and from the respective pressure chambers 48 is blocked. In the first operative position, the first inlet/out port 52 is in communication with the associated pressure chamber 48 and the second inlet/outlet port 54 is blocked therefrom. In the second operative position, the second inlet/out port 54 is in communication with the associated pressure chamber 48 and the first inlet/outlet port 52 is blocked therefrom.

The single pilot valve 98 is disposed between the single valving element 94 and the single electrically controlled actuator 96 and operative to control the fluid within a single pilot control chamber 100. The single pilot valve 98 controls communication of fluid between the source of low pressure fluid 26, the single pilot control chamber 100 and the reservoir 16.

FIGS. 1–6 set forth a method of controlling the relative position of respective ones of a plurality of pistons within a variable displacement fluid translating device. Various ones of the following steps are utilized in accomplishing this method. For example, some of the steps include providing a housing 40 having first and second inlet/outlet ports 52,54 with a reference axis 56 extending therethough; providing a rotating cam 42 having a cam surface 60 in the housing 40 along the reference axis 56; forming a plurality of pressure chambers 48 in the housing 40; providing a plurality of pistons 46 in the plurality of pressure chambers 48 that are slideably disposed therein and that are selectively in mating contact with the cam surface 60 of the rotating cam 42; establishing a plurality of pressure chambers 48 between the plurality of pistons 46 and the respective ones of the plurality of pressure chambers 48; and providing a valving arrangement 50 between each pressure chambers 48 and the respective ones of the first and second inlet/outlet ports 52,54. Each of the valving arrangements 50 being operative to selectively block the fluid flow in and out of each pressure chamber 48 to maintain the associated piston 46 at a predetermined position. Other steps include moving the respective pistons 46 a predetermined distance within the associated piston bore 44 and controlling the direction of flow into and out of the respective pressure chambers 48 for only a portion of the predetermined distance. Another step includes providing a controller 24 operatively connected to the variable displacement fluid translating device 12 and a speed and position sensor 22 associated with the variable displacement fluid translating device 12 that is operative to sense the speed and rotational position of the variable displacement fluid translating device 12 and direct a signal representative thereof to the controller 24.

It is recognized that various other embodiments of the variable displacement fluid translating device 12 and combinations of the work system 10 could be utilized without departing from the essence of the present invention.

INDUSTRIAL APPLICABILITY

In the operation of the work system 10 of FIG. 1, the pump 12 draws fluid from the reservoir 16 and delivers pressurized fluid to the fluid cylinder 18 through a directional control valve 20. As noted above, the fluid pump 12 of FIG. 1 operates only in the two quadrant mode. The first inlet/outlet port 52 (FIG. 4) is always the high pressure port and the second inlet/outlet port 54 (FIG. 4)is always the low pressure port or as illustrated in this embodiment, it is connected to the reservoir 16. The exhaust flow from the fluid cylinder 18 is directed across the directional control valve 20 to the reservoir 16 in a well known manner.

In the work system 10 of FIG. 2, the variable displacement fluid translating device 12 (pump) and the second variable displacement fluid translating device 12' (motor) each operate in the four quadrant mode. Consequently, each of the first and second inlet/outlet ports 52,54 serve as high and low pressure ports depending on the operating parameters of the work system 10. The work system 10 of FIG. 2 is a typical hydrostatic system in which the fluid pump 12 and the fluid motor 12' are fluidity connected together. The pilot pump 37 provides low pressure fluid through the first and second one way check valves 34,36 to both the conduits 30,32 and the fluid pump 12 and fluid motor 12'. The high pressure accumulator 28 is maintained at the highest system pressure level by its connection through the resolver valve 38 to the respective conduits 30,32 and is also connected to the fluid pump 12 and fluid motor 12' in order to receive any fluid resulting from an overpressure condition within the pump 12 or motor 12' and also functions to reduce fluid pressure ripples and/or fluid borne noise.

The speed and position sensors 22,22' functions to continually sense and deliver a signal to the controller 24 representative of the speed of the fluid pump 12 and the fluid motor 12'. Likewise, it also functions to continually monitor and deliver a signal to the controller 24 representative of the position of the rotating cam 42 within the fluid pump 12 and the fluid motor 12'. The controller 24 functions to control the displacement of the fluid pump 12 and fluid motor 12' relative to the operating parameters of the total work system 10.

In the work system 10 of FIG. 3, the variable displacement fluid translating device or pump 12 operates in the four quadrant mode like that of FIG. 2. However, the work element 18 of FIG. 3 is a typical fluid actuator 18. The pressurized fluid reservoir 16 serves as the source of low pressure fluid 26 and is connected to the conduits 30,32 through the respective pilot operated one way check valves 34',36'. When the pressure in the conduit 30 is at a higher pressure level than that in conduit 32, the pilot operated one way check valve 36' is forced to open in response to the higher pressure in conduit 30 and the pressure in the conduit 32 is maintained at least at the level of the pressure in the pressurized reservoir 16. When the pressure in the conduit 32 is higher than that in the conduit 30 the opposite occurs. The pressurized fluid in the pressurized reservoir 16 is also connected to the fluid pump 12 to provide the source of low pressure fluid 26 that will be explained below. All other operating aspects of the work system 10 of FIG. 3 is the same as that of FIG. 2.

Referring to the variable displacement fluid translating device 12 of FIG. 4, hereinafter referred to as a fluid pump 12, the operation thereof is described with it being used as a fluid pump 12. However, it is recognized that it is also applicable as a fluid motor. As the rotating cam 42 of the fluid pump 12 rotates, the plurality of pistons 40 are forced to reciprocate within the plurality of piston bores 44 due to the fact that they are in mating contact with the cam surface 60 of the rotating cam 42. As the rotating cam 42 rotates with respect to the plurality of pistons 46 from the bottom dead center position BDC towards the top dead center position TDC, the fluid in the respective ones of the plurality of pressure chambers 48 is forced out towards the first inlet/outlet port 52. In order for the fluid within the respective pressure chambers 48 to get to the first inlet/outlet port 52, the fluid must pass through the first valve seat 68 pass by the ball check 72 to the first inlet/outlet port 52 or pressure side of the fluid pump 12 leading to the work element 18. Simultaneously, fluid must be received from the second inlet/outlet port 54 or low pressure side and delivered to the pressure chambers 48 from which the associated pistons 46 are moving from the top dead center TDC position towards the bottom dead center position BDC. In order for fluid from the low pressure side to get to the pressure chambers 48 that are being filled, the ball check 72 seated on the second valve seat 70 must be moved. This is accomplished by the controller 24 directing a signal to the second electrically controlled actuator 78 which then forces the ball check 72 thereof to the operative, flow passing position. In this pumping mode, the ball check 72 is moved to a position between the first and second valve seats 68,70. As long as the pumping mode remains active pressurized fluid at full displacement is pumped through the first inlet/outlet port 52 to the work element 18.

When the fluid pump 12 is operating in a work system requiring the four quadrant mode and the fluid direction is reversed, the opposite occurs. That is, the first valving assembly 64 is actuated and the second valving assembly 66 remains in its unactuated position with the ball check 72 seated against the first valve seat 68.

In order for the fluid pump 12, to operate in the motoring mode, both of the first and second electrically controlled actuators 76,78 need to be energized at the same time during the intake stroke to move the ball checks 72 of the first and second valving assemblies 64,66 against their respective second valve seats 66. During the exhaust stroke, both of the first and second electrically controlled actuators 76,78 are de-energized to permit both of the ball checks 72 to return to the respective first valve seats 64.

In the event of over pressurization within either of the pressure chambers 48, the associated relief valve 80 opens to vent fluid therefrom to the high pressure accumulator 28 thus removing the over pressure condition. During initial startup of the subject fluid pump 12, it may be necessary to introduce pressurized fluid into the respective pressure chambers 48. The orifice 82 and one way check 84 function to permit a small amount of low pressure fluid to be introduced into the respective pressure chambers 48 during startup. After startup, the one way check 84 blocks reverse flow from the pressure chambers 48 to the source of low pressure fluid 26.

In order to vary the displacement of the fluid pump 12, any one or more of the plurality of pistons 46 are selectively stopped thus removing its effective volume of fluid from the total volume. This is accomplished by continuously holding the ball check 72 of the second valving assembly 66 in a position between the first and second valve seats 68,70 while leaving the ball check 72 of the first valving assembly 64 seated against the first valve seat 68. This permits the selected piston or pistons 46 to continue to reciprocate in and out. However, during the pumping stroke the fluid being expelled is being directed back to the second inlet/outlet port 54 through the second, open valving assembly 66. If the flow direction through the fluid pump 12 is reversed, the ball check 72 of the first valving assembly 66 is positioned between the first and second valve seats 68,70 while the ball check 72 of the second valving assembly 66 remains against the first valve seat 68 thereof.

The displacement of the fluid pump 12 can also be varied by controlling the volume that each piston 46 can produce. This is accomplished by permitting the selected one or ones of the pistons 46 to effectively pump a portion of their total volume and bypass the remaining portion. Likewise, it is possible to pump a first portion of the volume, bypass an intermediate portion and pump the remaining portion of the total volume of fluid. This is accomplished by the controller 24 selectively controlling actuation of the second valving assembly 66 between it neutral and operative positions.

In order to totally stop the flow of fluid into and out of the selected piston or piston 46 in either direction of fluid flow, both of the first and second electrically controlled actuators 76,78 are de-energized just prior to the respective selected piston or pistons 46 reaching their top dead center TDC positions. Consequently, the respective selected piston or pistons 46 are hydraulically locked or stopped at the top dead center position TDC and do not reciprocate in and out until it is desired to recombine their flows into the total flow output. When it is desired to activate the deactivated selected piston or pistons 46, the second electrically controlled actuator 78 is energized near top dead center TDC, assuming that the flow direction is towards the first inlet/outlet port 52, to move the ball check 72 of the second valve assembly 66 towards the second valve seat 70.

In the operation of the variable displacement fluid translating device 12 of FIG. 5, all aspects with respect to the operation of FIG. 4 is the same except the first and second valving assemblies 64,66 are different. When the pressurized fluid flow is in the direction of the first inlet/outlet port 52, the second valving assembly 66 that is associated with each of the pistons that are forcing fluid out of the respective pressure chambers 48 is actuated and the first valving assembly 64 of each remain unactuated. Consequently, the pressurized fluid in the associated pressure chambers 48 act on the pilot operated poppet valve 88 urging it towards the operative, flow passing position to direct the pressurized fluid to the inlet/outlet port 52. The pilot valve 90 of the first valving assembly 64 acts to block the pressure in the respective pressure chamber 48 from the pilot control chamber 92 and permit the pressure at the inlet/outlet port 52 to be communicated with the pilot control chamber 92. The pressure in the pressure chamber 48 acting on the pilot operated poppet valve 88 is sufficient to move the pilot operated poppet valve 88 towards its open position.

At the same time, the pilot valve 90 of the second valving assembly 66 is actuated to move it to a position to communicate the pressure in the pressure chamber 48 to the pilot control chamber 92 of the second valving assembly 66 and blocks the communication of the pressure at the second inlet/outlet port 54 with the pilot control chamber 92 thereof. Consequently, the higher pressure being subjected to the pilot control chamber 92 of the second valving assembly 66 maintains the pilot operated poppet valve 88 of the second valving assembly 66 in its neutral, flow blocking position.

Once all of the fluid has been expelled from the respective pressure chambers 48 and the associated pistons 46 begin to retract, the pressure within the pressure chambers 48 thereof is quickly reduced. Since the pressure of the fluid at the first inlet/outlet port 52 is communicated with the pilot control chamber 92 of the first valving assembly 64, the pilot operated poppet valve 88 thereof is held firmly against its valve seat 86. Since the pressure of the fluid in the pilot control chamber 92 of the second valving assembly 66 is also in communication with the lowered pressure in the pressure chambers 48, the pressure of the fluid at the second inlet/outlet port 54 is sufficient to open the pilot operated poppet valve 88 of the second valving assembly 66 to fill the pressure chambers 48 as they retract. If fluid flow is in the opposite direction, the opposite operation would occur.

In the motoring mode of operation, both of the first and second valving assemblies 64,66 are actuated during the intake stroke, i. e. when receiving high pressure. During the exhaust stroke, both are returned to their unactuated positions. Typically, to aid in timing, just before BDC the electrically controlled actuator 76/78 of the associated valving assembly 64/66 on the high pressure side of the pump 12 is de-energized and the electrically controlled actuator 76/78 of the associated valving assembly 64/66 on the low pressure side of the pump 12 is de-energized at BDC. Likewise, just before TDC the valving assembly 64/66 of the low pressure side is actuated and the valving assembly 64/66 on the high pressure side is actuated at TDC. Thereafter, the whole cycle repeats.

In the event of an over pressure condition within the respective pressure chambers 48, the respective pilot control chambers 92 of the first and second valving assemblies 64,66 are connected to the relief valve 80. Consequently, any over pressure condition can be released across the associated one of the pilot operated poppet valves 88 of the first and second valve assemblies 64,66 to one of the first and second inlet/outlet ports 52,54.

In order to vary the displacement of the fluid pump 12 with the direction of fluid flow being towards the first inlet/outlet port 52, the second valving assembly 66 of a selected one or ones of the pistons 46 that are expelling fluid remains unactuated along with the first valving assembly being unactuated. Consequently, the fluid being pressurized in the associated pressure chamber 48 acts on the pilot operated poppet valve 88 of the second valving assembly 66 and urges it towards its open position thus directing the fluid to the second, low pressure inlet/outlet port 54. Once the associated piston 46 reaches the TDC position, the second valving assembly 66 is actuated and the pressure chamber 48 fills with fluid as the piston 46 retracted from the piston bore 44.

The displacement of the fluid pump 12 can also be varied by permitting a selected one or ones of the pistons 46 to pump only a portion of their total volume and bypass the remaining portion to the low pressure side. This is accomplished by the controller 24 selectively controlling the actuation of the second valving element 66. Since the velocity of the respective pistons 46 are their highest at a position between the bottom dead center position BDC and the top dead center positions TDC, it may be advantageous to use only the first and/or last portions of the total volumes and bypass the mid portion thereof.

In order to reduce the total required energy in the work system 10, the fluid flow that is not being used for useful work can be eliminated. By leaving the second valving assembly 66 unactuated when the piston 46 reaches the TDC position, the piston 46 is hydraulically locked at the TDC position. When it is desired to once again increase the pumps displacement, the second valving assembly 66 is actuated at the TDC position so that the pressure chamber 48 can refill and the piston 46 again contacts the cam surface 60 and retracts as the rotating cam turns. Naturally, if the flow direction is in the direction of the second inlet/outlet port 54, the operation would be just the opposite.

In the operation of the embodiment of FIG. 6, all aspects with respect to the operation of FIG. 5 is the same except the valving arrangement 50 of FIG. 6 only has a single valving element 94 connected between the respective pressure chambers 48 and the first and second inlet/outlet ports 52,54 and the respective pressure chambers 48 are connected through respective relief valves 80 to the high pressure accumulator 28 to control overpressure conditions.

When the flow of fluid is towards the first inlet/outlet port 52, the single valving element 94 is moved from its neutral, flow blocking position towards its first operative position to direct pressurized fluid from the pressure chamber 48 of the pistons 46 that are expelling fluid to the first inlet/outlet port 52. At the same time, the single valving element 94 of the pressure chambers 48 that are being filled due to the pistons 46 retracting is moved from its flow blocking position to its second operative position to connect the associated pressure chambers 48 to the second inlet/outlet port 54. When the pistons 46 that are pumping pressurized fluid reaches their respective TDC positions, the single valving element 94 associated therewith moves from the first operative position towards the second operative position. Likewise, when the pistons 46 that are retracting reaches their respective BDC positions, the single valving element 94 associated therewith moves from their second operative position towards their first operative positions. If the flow direction is changed towards the second inlet/outlet port 54, the reverse operation occurs.

When it is desired to reduce the displacement from the pump 12 with the flow in the direction of the first inlet/outlet port 52, a selected one or ones of the single valving elements 94 is moved from its neutral, flow blocking position towards its second operative position to connect the associated pressure chamber 48 to the second inlet/outlet port 54 that is functioning as the low pressure port. The single valve element 94 of the selected one or ones of the pistons that are not being used to provide useful flow remains in the second operative position until the flow therefrom is again needed to do useful work.

As set forth with respect to FIGS. 4 and 5, it is also possible to vary the volume of fluid delivered from the embodiment of FIG. 6 by using only a portion of the total volume being pumped from the respective pressure chambers 48. The controller 24 controls the operation of the respective single valving members 94 to direct portions of the pumped fluid to the high pressure side and to bypass other portions thereof to the low pressure side.

In order to eliminate the wasted energy in the system due to the pumping of flow that is not being used to do useful work, the piston 46 that is being bypassed is stopped at TDC and not permitted to move. This is accomplished by maintaining the single valving element 94 of the selected one or ones of the pistons 46 being bypassed in its neutral, flow blocking position. With the single valving element 94 in its neutral position, the associated piston is hydraulically locked at that position. Consequently, the cam surface 60 separates from the piston 46. Once the flow from the stopped piston is needed, the single valving element 94 is moved to its first operative position as set forth above.

In view of the above, it is readily apparent that the fluid translating device 12 provides a pump/motor in which the displacement thereof is changed by not using fluid flow from selected one(s) of the pistons therein. It also conserves energy within the work system by stopping the motion of the selected one or ones of the pistons when the displacement therein is being varied thus not permitting unused fluid to be unnecessarily pumped at low pressure through the work system 10.

Other aspects, objects and advantages of the invention can be obtained from a study of the drawings, the disclosure and the appended claims.

What is claimed is:

1. A variable displacement fluid translating device, comprising:

a housing having first and second inlet/outlet ports and defining a reference axis therethrough a rotating cam disposed in the housing along the reference axis and having a cam surface;

a plurality of piston bores defined in the housing about the reference axis and each bore of the plurality of piston bores having a bottom portion;

a plurality of pistons slideably disposed in the plurality of piston bores and selectively in mating contact with the cam surface of the rotating cam;

a plurality of pressure chambers defined in the housing between the respective one of the plurality of pistons and the bottom portion of the respective ones of the plurality of piston bores;

a valving arrangement connected between selected pressure chambers of the plurality of pressure chambers and the respective first and second inlet/outlet ports and being operative to selectively block fluid flow in and out of each pressure chamber to hold the respective piston at a predetermined position, each of the valving arrangements including first and second valving assemblies; and first and second electrically controlled actuators operatively connected to each of the first and second valving assemblies.

2. The variable displacement fluid translating device of claim 1 wherein, the first valving assembly is disposed between the associated pressure chamber and the first inlet/outlet port and the second valving assembly is disposed between the associated pressure chamber and the second inlet/outlet port.

3. The variable displacement fluid translating device of claim 2 wherein each of the first and second valving assemblies are movable from a neutral, flow blocking position towards an operative, flow passing position in response to actuation of the associated electrically controlled actuator.

4. The variable displacement fluid translating device of claim 3 wherein each of the pistons has a top dead center position and when the first and second valving assemblies are held in their neutral, flow blocking positions, fluid flow in and out of the respective pressure chambers is blocked and the associated piston is held at its top dead center position.

5. The variable displacement fluid translating device of claim 4 wherein the variable displacement fluid translating device is a radial variable displacement fluid translating device.

6. The variable displacement fluid translating device of claim 4 wherein the variable displacement fluid translating device is a fluid pump.

7. The variable displacement fluid translating device of claim 4 wherein the variable displacement fluid translating device is a fluid motor.

8. The variable displacement fluid translating device of claim 4 in combination with a controller operatively connected to the variable displacement fluid translating device and a speed and position sensor operatively associated with the variable displacement fluid translating device and operative to sense the speed and position of rotation of the variable displacement fluid translating device and deliver a signal representative thereof to the controller.

9. A method of controlling the relative position of respective ones of a plurality of pistons within a variable displacement fluid translating device, comprising the steps:

providing a housing having first and second inlet/outlet ports and a reference axis;

providing a rotating cam having a cam surface in the housing along the reference axis;

forming a plurality of piston bores in the housing about the reference axis;

providing a plurality of pistons in the plurality of piston bores that are slideably disposed in the respective piston bores and that are selectively in mating contact with the cam surface of the rotating cam;

establishing a plurality of pressure chambers between the respective one of the plurality of pistons and the respective ones of the plurality of piston bores; and providing first and second valving assemblies between one selected pressure chamber of the plurality of pressure chambers and the respective first and second inlet/outlet ports, the first and second valving assemblies being operative to selectively block the fluid flow in and out of the one pressure chamber to maintain the associated piston at a predetermined position.

10. The method of claim 9 including the step of holding the selected pistons at a top dead center position.

11. The method of claim 9 wherein the step of providing a plurality of pistons slideably disposed in the plurality of piston bores includes the step of moving the respective pistons a predetermined distance within the associated piston bore of the plurality of piston bores and the step of providing first and second valving assemblies includes the step of controlling the direction of flow into and out of the pressure chamber for only a portion of the predetermined distance.

12. The method of claim 11 including the step of providing a controller operatively connected to the variable displacement fluid translating device and a speed and position sensor associated with the variable displacement fluid translating device and operative to sense the speed of and the rotational position of the variable displacement fluid translating device and direct a signal representative thereof to the controller.

* * * * *